US012714904B1

(12) United States Patent
Mcdermott-Latallade et al.

(10) Patent No.: US 12,714,904 B1
(45) Date of Patent: Aug. 25, 2026

(54) THERAPEUTIC EXERCISE DEVICE FOR HAND AND ARM

(71) Applicants: Donna Mcdermott-Latallade, Rockaway, NJ (US); Efrain Antonio Latallade, Jr., Rockaway, NJ (US); Kevin Antonio Latallade, Rockaway, NJ (US)

(72) Inventors: Donna Mcdermott-Latallade, Rockaway, NJ (US); Efrain Antonio Latallade, Jr., Rockaway, NJ (US); Kevin Antonio Latallade, Rockaway, NJ (US)

( * ) Notice: Subject to any disclaimer, the term of this patent is extended or adjusted under 35 U.S.C. 154(b) by 0 days.

(21) Appl. No.: 18/788,385

(22) Filed: Jul. 30, 2024

(51) Int. Cl.

| | |
|---|---|
| ***A63B 21/00*** | (2006.01) |
| ***A41D 19/00*** | (2006.01) |
| ***A63B 21/04*** | (2006.01) |
| ***A63B 21/055*** | (2006.01) |
| ***A63B 23/16*** | (2006.01) |

(52) U.S. Cl.
CPC ..... *A63B 21/4019* (2015.10); *A41D 19/0055* (2013.01); *A63B 21/0442* (2013.01); *A63B 21/0557* (2013.01); *A63B 21/151* (2013.01); *A63B 23/16* (2013.01)

(58) Field of Classification Search
None
See application file for complete search history.

(56) References Cited

U.S. PATENT DOCUMENTS

| | | | | | |
|---|---|---|---|---|---|
| 2,584,203 | A | * | 2/1952 | Hart | A61F 5/04 24/129 D |
| 3,850,166 | A | * | 11/1974 | Tamny | A61F 5/04 602/40 |
| 3,872,861 | A | | 3/1975 | Tamny | |
| 4,445,506 | A | * | 5/1984 | Johansson | A61F 5/04 D24/140 |
| 5,074,291 | A | | 12/1991 | Carter | |
| 5,229,178 | A | * | 7/1993 | Zemitis | A63B 5/16 100/9 |
| 5,451,203 | A | | 9/1995 | Lamb | |
| 5,649,541 | A | | 7/1997 | Stuckey | |
| 5,735,806 | A | * | 4/1998 | Leibovic | A61F 5/04 24/115 M |
| 6,811,541 | B2 | | 11/2004 | Lambert | |

(Continued)

FOREIGN PATENT DOCUMENTS

| | | | | |
|---|---|---|---|---|
| CN | 216985325 U | * | 7/2022 | |
| CN | 116616841 A | * | 8/2023 | A61B 17/02 |
| WO | 2010090507 | | 8/2010 | |

*Primary Examiner* — Shila Jalalzadeh Abyaneh
(74) *Attorney, Agent, or Firm* — Kyle A. Fletcher, Esq.

(57) ABSTRACT

The therapeutic exercise device for hand and arm is a strength training device. The therapeutic exercise device for hand and arm provides the resistance required to strengthen the hand. The therapeutic exercise device for hand and arm includes a glove structure, a suspension structure, and an anchor cord. The suspension structure attaches the glove structure to the anchor cord. The anchor cord: a) secures the therapeutic exercise device for hand and arm to an externally provided anchor point; and, b) suspends the therapeutic exercise device for hand and arm from the anchor point. The glove structure is a trankless glove that is worn on the hand. The glove structure provides the resistance to strengthen the hand.

11 Claims, 4 Drawing Sheets

(56) References Cited

U.S. PATENT DOCUMENTS

| | | | | |
|---|---|---|---|---|
| 7,131,955 | B2 * | 11/2006 | Price | A61F 5/3761 602/20 |
| 7,857,780 | B2 * | 12/2010 | Sommers | A61F 5/3761 602/20 |
| 8,968,158 | B2 * | 3/2015 | Poli | A63B 21/023 482/46 |
| 10,456,315 | B2 | 10/2019 | Adimari | |
| D954,164 | S | 6/2022 | Qin | |
| 11,395,756 | B2 * | 7/2022 | Altshuler | A61F 5/3761 |
| 2003/0220595 | A1 * | 11/2003 | Lambert | A61F 5/3761 602/36 |
| 2004/0147378 | A1 * | 7/2004 | Conklin | A63B 21/169 482/124 |
| 2006/0161086 | A1 * | 7/2006 | Lambert | A61F 5/3761 602/32 |
| 2009/0275444 | A1 * | 11/2009 | Derry | A63K 3/04 482/17 |
| 2011/0178449 | A1 * | 7/2011 | Foote | A61F 5/05858 602/36 |
| 2017/0368400 | A1 * | 12/2017 | Chapman | A63B 21/0442 |

* cited by examiner

THERAPEUTIC EXERCISE DEVICE FOR HAND AND ARM

CROSS REFERENCES TO RELATED APPLICATIONS

Not Applicable

STATEMENT REGARDING FEDERALLY SPONSORED RESEARCH

Not Applicable

REFERENCE TO APPENDIX Not Applicable

BACKGROUND OF THE INVENTION

Not Applicable

SUMMARY OF INVENTION

The therapeutic exercise device for hand and arm is a therapeutic device. The therapeutic exercise device for hand and arm is a strength training device. The therapeutic exercise device for hand and arm is adapted for use with a hand. The therapeutic exercise device for hand and arm provides the resistance required to strengthen the hand. The therapeutic exercise device for hand and arm comprises a glove structure, a suspension structure, and an anchor cord. The suspension structure attaches the glove structure to the anchor cord. The anchor cord: a) secures the therapeutic exercise device for hand and arm to an externally provided anchor point; and, b) suspends the therapeutic exercise device for hand and arm from the anchor point. The glove structure is a trunkless glove that is worn on the hand. The glove structure provides the resistance to strengthen the hand.

These together with additional objects, features and advantages of the therapeutic exercise device for hand and arm will be readily apparent to those of ordinary skill in the art upon reading the following detailed description of the presently preferred, but nonetheless illustrative, embodiments when taken in conjunction with the accompanying drawings.

In this respect, before explaining the current embodiments of the therapeutic exercise device for hand and arm in detail, it is to be understood that the therapeutic exercise device for hand and arm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the therapeutic exercise device for hand and arm.

It is therefore important that the claims be regarded as including such equivalent construction insofar as they do not depart from the spirit and scope of the therapeutic exercise device for hand and arm. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
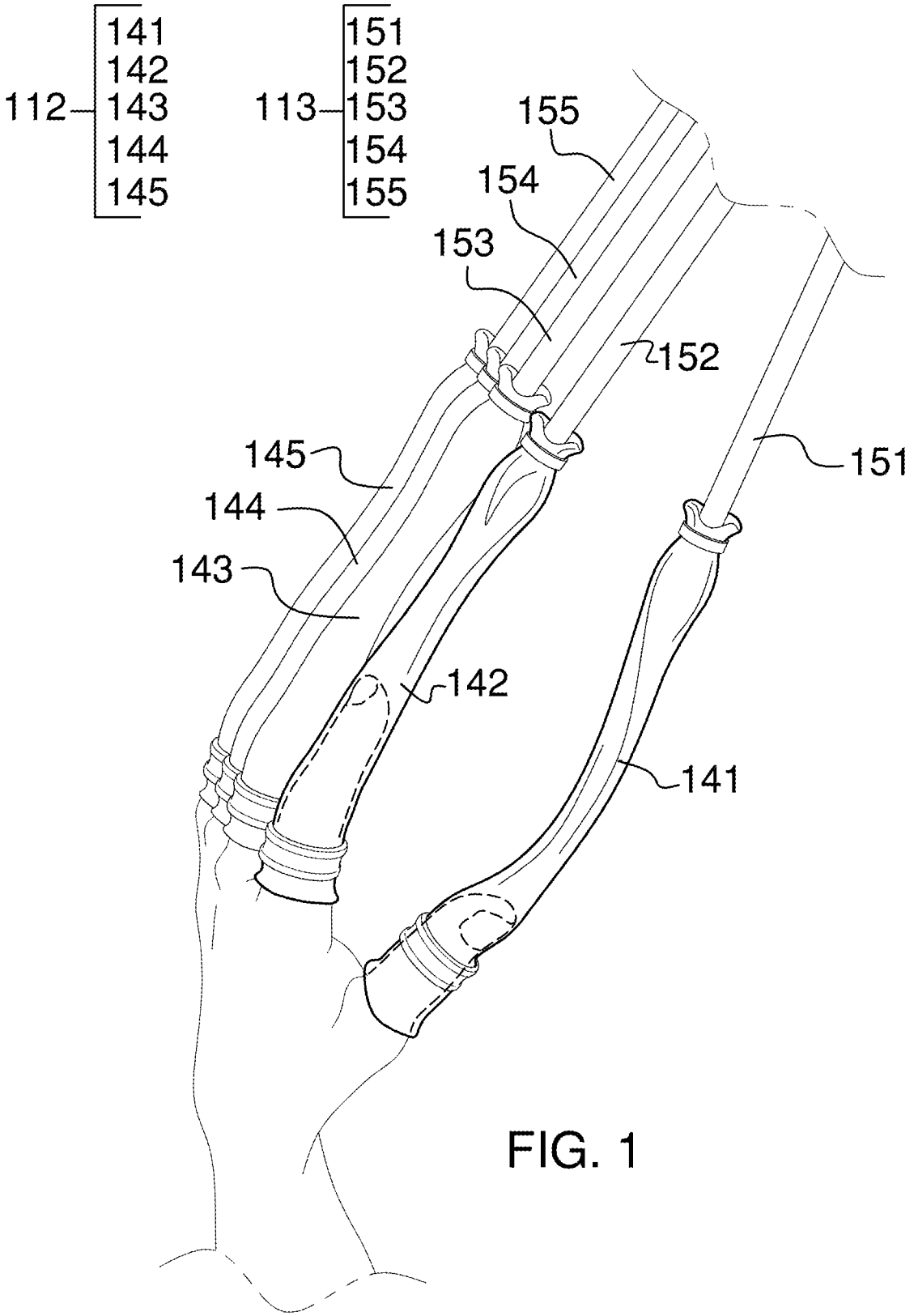
FIG. 1 is a perspective view of an embodiment of the disclosure.
Figure 2:
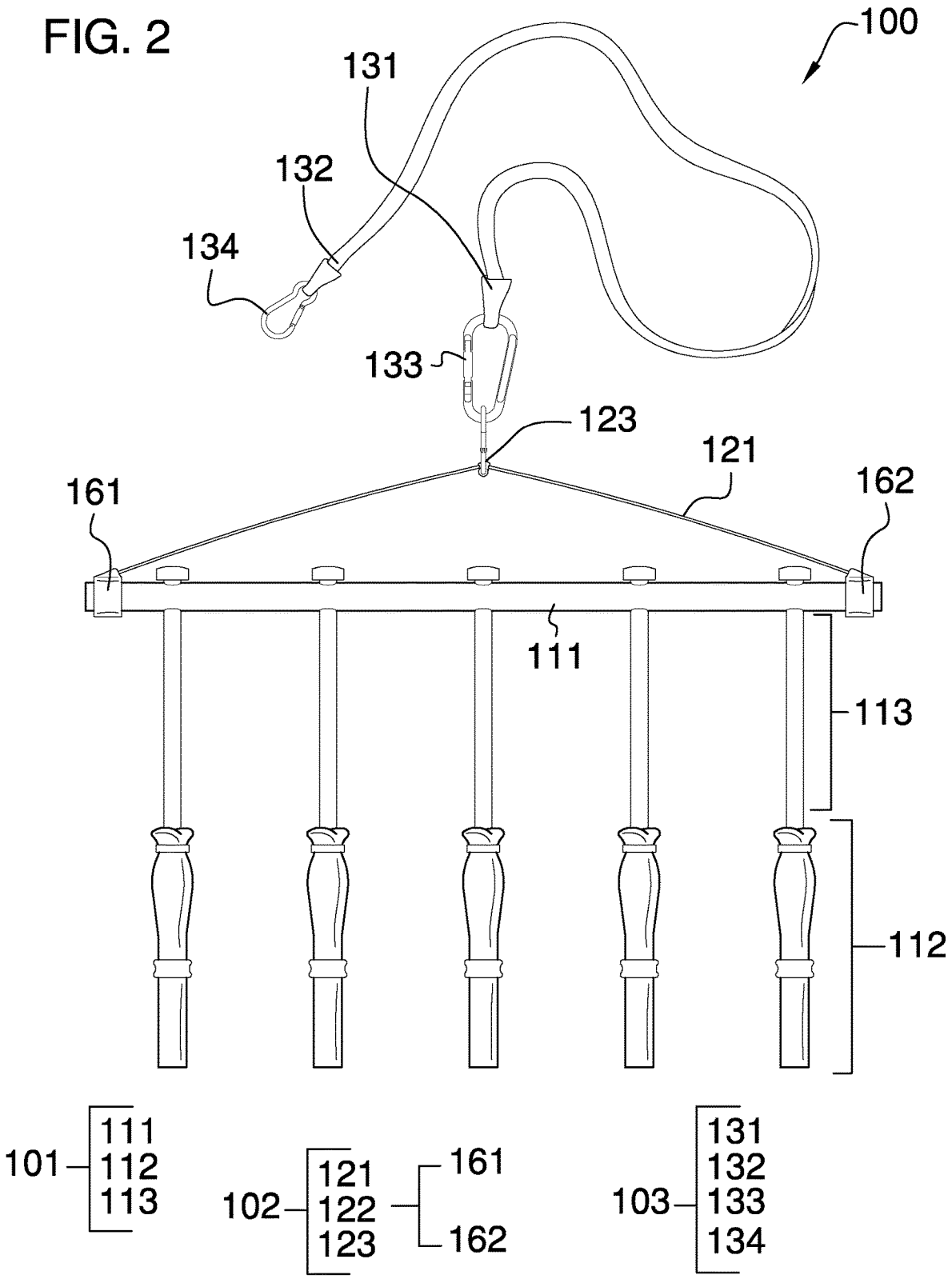
FIG. 2 is a front view of an embodiment of the disclosure.
Figure 3:
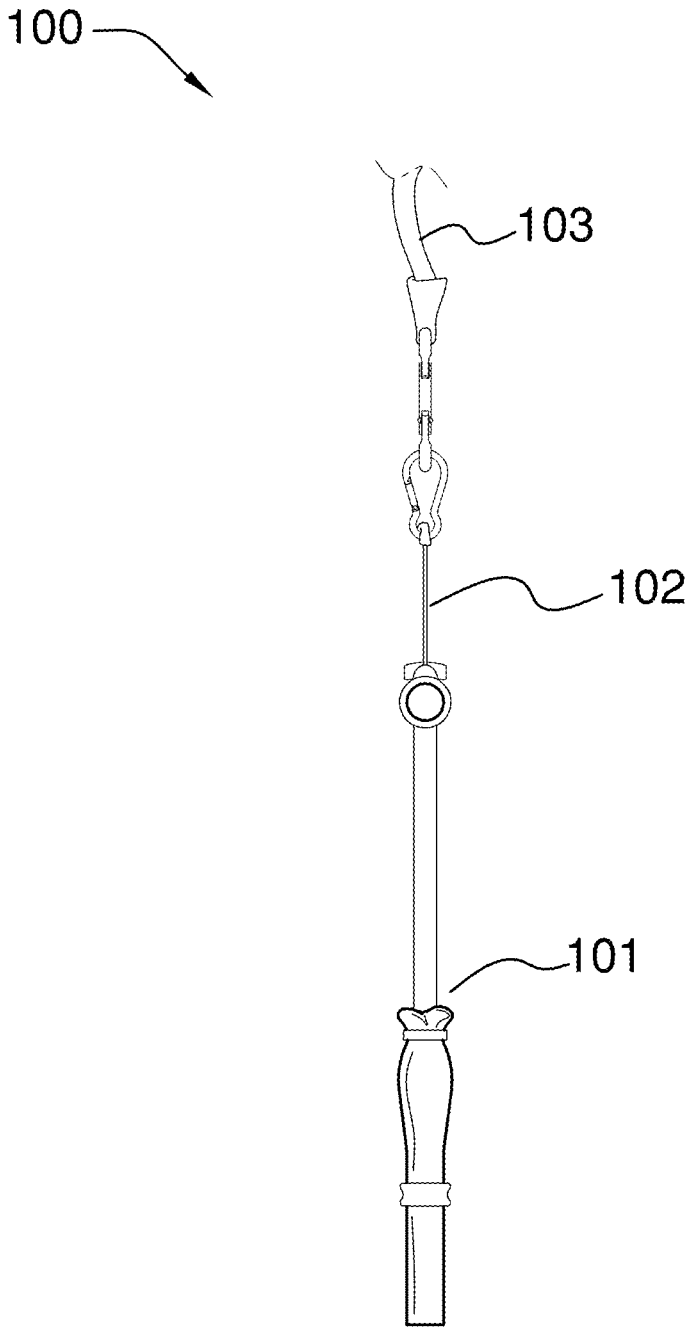
FIG. 3 is a side view of an embodiment of the disclosure.
Figure 4:
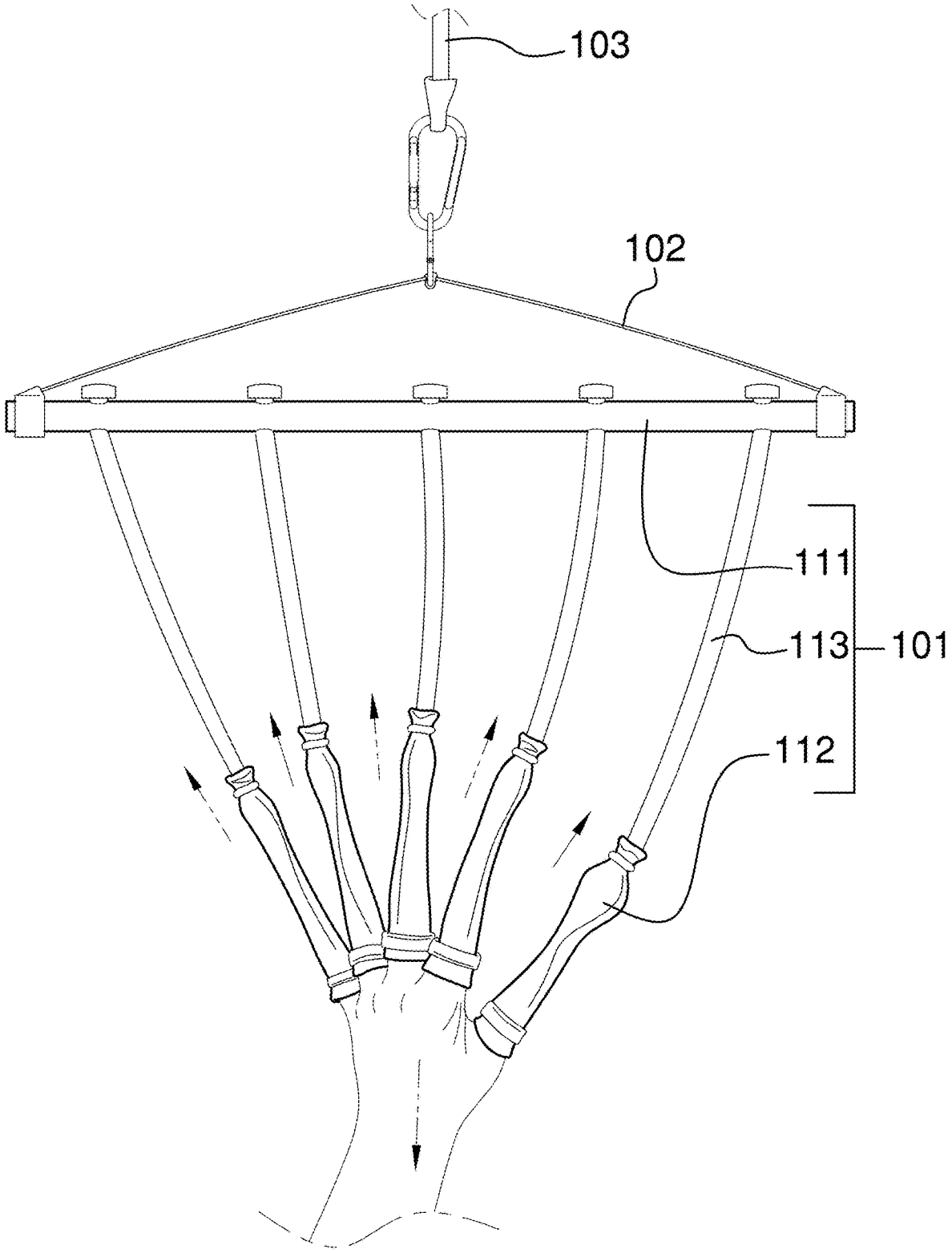
FIG. 4 is an in-use view of an embodiment of the disclosure.

Detailed reference will now be made to one or more potential embodiments of the disclosure, which are illustrated in FIGS. 1 through 4.

The therapeutic exercise device for hand and arm 100 (hereinafter invention) is a therapeutic device. The invention 100 is a strength training device. The invention 100 is adapted for use with a hand. The invention 100 provides the resistance required to strengthen the hand. The invention 100 comprises a glove structure 101, a suspension structure 102, and an anchor cord 103. The suspension structure 102 attaches the glove structure 101 to the anchor cord 103. The anchor cord 103: a) secures the invention 100 to an externally provided anchor point; b) suspends the invention 100 from the anchor point. The glove structure 101 is a trunkless glove that is worn on the hand. The glove structure 101 provides the resistance to strengthen the hand.

The glove structure 101 is a garment. The glove structure 101 is worn on the hand. The glove structure 101 secures the fingers of the hand to the suspension structure 102. The glove structure 101 is an elastic structure. The glove structure 101 is structured such that the movement of the hand and the fingers of the hand deforms the elastic structure of the glove structure 101. The deformation of the glove structure 101 provides the resistance that exercises the hand and the fingers of the hand. The glove structure 101 comprises an anchor bar 111, a plurality of finger stalls 112, and a plurality of elastic cords 113.

The anchor bar 111 is a prism shaped structure. The anchor bar 111 is a rigid structure. The anchor bar 111 attaches to the suspension structure 102. The anchor bar 111 is a load bearing structure. The anchor bar 111 forms a load path that transfers the loads of the plurality of elastic cords 113 and the plurality of finger stalls 112 to the suspension structure 102. The anchor bar 111 forms the structure that suspends the plurality of elastic cords 113 and the plurality of finger stalls 112 above a supporting surface.

Each finger stall selected from the plurality of finger stalls 112 is a tubular structure. Each selected finger stall is an elastic structure. Each finger stall selected from the plurality of finger stalls 112 is associated with a finger selected from the fingers of the hand.

There is a one to one correspondence between the plurality of finger stalls 112 and the plurality of elastic cords 113. Each finger stall selected from the plurality of finger stalls 112 is associated with an elastic cord selected from the plurality of elastic cords 113. A congruent end of the tubular structure of each selected finger stall attaches to its associated selected elastic cord.

The plurality of elastic cords 113 form the elastic structure of the invention 100 that provides the resistance that is used to exercise the hand and the fingers of the hand. The plurality of elastic cords 113 are deformed by the energy of the movement of the hand and the fingers of the hand. Each elastic cord selected from the plurality of elastic cords 113 is a cord. Each selected elastic cord is an elastic structure. Each selected elastic cord attaches to the anchor bar 111. Each selected elastic cord attaches to an associated finger stall selected from the plurality of finger stalls 112. Each selected elastic cord transfers the load of the associated finger stall to the anchor bar 111.

Each finger stall selected from the plurality of finger stalls 112 acts as a spring. When the finger associated with any selected finger stall inserts into the selected finger stall, a radial force is applied to the lateral face of the tubular structure of the selected finger stall in a direction perpendicular to the center axis of the selected finger stall. The applied radial force elongates the span of the length of the diameter of the selected finger stall in the direction perpendicular to the center axis of the selected finger stall. The elasticity of the selected finger stall creates a force that opposes the displacement created by the applied radial force. The opposing force is in a direction that returns the selected finger stall to its relaxed shape. The associated finger will prevent the selected finger stall from returning to its relaxed shape. In this circumstance, the selected finger stall will apply a radial force towards the center axis of the of the selected finger stall that binds the selected finger stall to the associated finger with a tight fit. The selected finger stall transfers the motion of the associated finger and the hand to its associated elastic cord selected from the plurality of elastic cords 113.

The plurality of finger stalls 112 comprises a first finger stall 141, a second finger stall 142, a third finger stall 143, a fourth finger stall 144, and a fifth finger stall 145.

The first finger stall 141 is a finger stall selected from the plurality of finger stalls 112. The first finger stall 141 is the finger stall that is associated with the first finger of the hand.

The second finger stall 142 is a finger stall selected from the plurality of finger stalls 112. The second finger stall 142 is the finger stall that is associated with the second finger of the hand.

The third finger stall 143 is a finger stall selected from the plurality of finger stalls 112. The third finger stall 143 is the finger stall that is associated with the third finger of the hand.

The fourth finger stall 144 is a finger stall selected from the plurality of finger stalls 112. The fourth finger stall 144 is the finger stall that is associated with the fourth finger of the hand.

The fifth finger stall 145 is a finger stall selected from the plurality of finger stalls 112. The fifth finger stall 145 is the finger stall that is associated with the fifth finger of the hand.

The plurality of elastic cords 113 comprises a first elastic cord 151, a second elastic cord 152, a third elastic cord 153, a fourth elastic cord 154, and a fifth elastic cord 155.

The first elastic cord 151 is an elastic cord selected from the plurality of elastic cords 113. The first elastic cord 151 is the elastic cord that secures the first finger stall 141 to the anchor bar 111.

The second elastic cord 152 is an elastic cord selected from the plurality of elastic cords 113. The second elastic cord 152 is the elastic cord that secures the second finger stall 142 to the anchor bar 111.

The third elastic cord 153 is an elastic cord selected from the plurality of elastic cords 113. The third elastic cord 153 is the elastic cord that secures the third finger stall 143 to the anchor bar 111.

The fourth elastic cord 154 is an elastic cord selected from the plurality of elastic cords 113. The fourth elastic cord 154 is the elastic cord that secures the fourth finger stall 144 to the anchor bar 111.

The fifth elastic cord 155 is an elastic cord selected from the plurality of elastic cords 113. The fifth elastic cord 155 is the elastic cord that secures the fifth finger stall 145 to the anchor bar 111.

The suspension structure 102 is a mechanical structure. The suspension structure 102 is a load bearing structure. The suspension structure 102 forms the load path the transfers the load the glove structure 101 to the anchor cord 103. The suspension structure 102 comprises a suspension cord 121, a plurality of anchor caps 122, and a bight loop 123.

The suspension cord 121 is a flexible structure. The suspension cord 121 is a cord. The suspension cord 121 forms the physical load path that transfers the load of the glove structure 101 to the anchor cord 103. The suspension cord 121 attaches to the plurality of anchor caps 122. The suspension cord 121 receives the load of the glove structure 101 through the plurality of anchor caps 122. The bight loop 123 is an anchor structure that is formed in the bight of the suspension cord 121. The bight loop 123 forms the structure that allows the anchor cord 103 to attach to the suspension cord 121.

Each anchor cap selected from the plurality of anchor caps 122 is a fastening device. Each selected anchor cap attaches to the anchor bar 111 of the glove structure 101. Each plurality of anchor caps 122 forms a load bearing structure. The plurality of anchor caps 122 forms the load path that transfers the load of the glove structure 101 from the anchor bar 111 to the suspension cord 121. The plurality of anchor caps 122 attach to the congruent ends of the anchor bar 111. The plurality of anchor caps 122 attaches to the ends of the suspension cord 121. The plurality of anchor caps 122 comprises a first anchor cap 161 and a second anchor cap 162.

The first anchor cap 161 is an anchor cap selected from the plurality of anchor caps 122. The first anchor cap 161 forms the structure that attaches the suspension cord 121 to an end of the suspension cord 121.

The second anchor cap 162 is an anchor cap selected from the plurality of anchor caps 122 second anchor cap 162 forms the structure that attaches the suspension cord 121 to the end of the suspension cord 121 that is distal from the first anchor cap 161.

The anchor cord 103 is a cord. The anchor cord 103 is roughly inelastic structure. The anchor cord 103 is a load bearing structure. The anchor cord 103 forms a load path that transfers the loads of the suspension structure 102 and the glove structure 101 to an externally provided anchor point. The anchor cord 103 suspends the suspension structure 102 and the glove structure 101 from the externally provided anchor point. The anchor cord 103 comprises a working end 131, a standing end 132, a working carabiner 133, and a standing carabiner 134.

The working end 131 is the end of the anchor cord 103 that receives the load of the suspension structure 102 and the glove structure 101. The standing end 132 is the end of the anchor cord 103 that transfers the load of the suspension structure 102 and the glove structure 101 to the externally provided anchor point. The working carabiner 133 is a fastening device. The working carabiner 133 attaches to the working end 131 of the anchor cord 103. The working carabiner 133 forms the structure of the anchor cord 103 that attaches the working end 131 to the bight loop 123 of the suspension cord 121. The standing carabiner 134 attaches to the standing end 132 of the anchor cord 103. The standing carabiner 134 forms the structure of the anchor cord 103 that attaches the standing end 132 to the externally provided anchor point.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Appendage: As used in this disclosure, appendage is a generic term used to describe one or more limbs of a patient. An appendage that primarily transfers the load of the patient to a supporting surface is referred to as a leg. An appendage without this primary purpose is referred to as an arm. The term limb is a synonym for appendage.

Associate: As used in this disclosure, the term associate is used to describe a relationship between a first object and a second object. The use of the term associated implies both: a) that the first object works with the second object in order to accomplish a task necessary for the implementation of the invention (such as joining two objects together); and, b) the relationship remains stable through the accomplishment of the task. By stable is meant that neither the first object or the second object are intended to be interchanged with a third object during the use of the invention.

Bight: As used in this disclosure, a bight refers to the central point of a flexible strap or strip.

Carabiner: As used in this disclosure, a carabiner is coupling link that is usually formed as an oblong metal ring with one spring hinged side that is used to open and close the ring. Synonyms for carabiner include D-link. A carabiner that has the ability to lock the spring hinged side into a closed position is called a locking carabiner. A carabiner is said to clip onto an anchor point.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exercise: As used in this disclosure, to exercise is a verb that refers to one or more physical activities that cause an individual to exert their muscles and organs such that the performance of the individual in the one or more physical activities will improve over a period of time. Each of the one or more physical activities are referred to as an exercise. Exercises are commonly classified as endurance exercises and strength training exercises. An endurance exercise focuses on improving the stamina and cardiovascular health of the individual. Strength exercises focus on improving the force, power, or work that can be generated from the muscles of the individual. A strength exercise that requires an individual to overcome an opposing force is referred to a resistance based exercise. Strength exercises are commonly classified as isometric exercises and isotonic exercises. An isometric exercise involves a motion that contracts the muscles of the individual without requiring the rotation of a joint of the individual. An isotonic exercise involves a motion that requires the rotation of a joint during the contraction of the muscle of the individual.

Exterior: As used in this disclosure, the exterior is used as a relational term that implies that an object is not contained within the boundary of a structure or a space.

Extremity: As used in this disclosure, extremity is a generic term used to describe either the hand and/or foot of a person. The extremity is located and the distal end of an appendage.

Flexible: As used in this disclosure, flexible refers to an object or material that will deform when a force is applied to it but that will not necessarily return to its original shape when the deforming force is removed.

Finger: As used in this disclosure, a finger is the portion of the hand that encloses the proximal phalange bone and its associated distal phalange bone of a hand. The fingernail is a claw like structure that is formed at the distal end of the finger. The finger of the hand that is formed without an intermediate phalange bone is referred to as the thumb. When sequentially numbering the fingers of the hand, the thumb is taken to be the first finger. The second finger of the hand is commonly referred to as the index finger. The third finger of the hand is commonly referred to as the middle finger. The fourth finger of the hand is commonly referred to as the ring finger. The fifth finger of the hand is commonly referred to as the little finger or "pinky."

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger.

Fitted: As used in this disclosure, the term fitted refers to two geometrically similar structures wherein the smaller geometrically similar structure inserts into the larger geometrically similar structure.

Force of Gravity: As used in this disclosure, the force of gravity refers to a vector that indicates the direction of the pull of gravity on an object at or near the surface of the earth.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Garment: As used in this disclosure, a garment is a textile based structure that is used to cover an individual. Clothes, clothing, and apparel are synonyms for garment.

Glove: As used in this disclosure, a glove is an item of apparel that covers a hand. The glove comprises five finger stalls into which the fingers of the hand are inserted. The glove further comprises the trank which encloses the hand form the fingers to the wrist. A glove is further defined with a palm side and a back side. The palm side is proximal to the palm of the hand. The back side is distal from the palm side.

Hand: As used in this disclosure, the hand is the extremity of the arm. The hand attaches to the wrist at the end of the arm that is distal from the shoulder. The hand comprises a plurality of metacarpal bones and a plurality of phalange bones.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Interphalangeal Joint: As used in this disclosure, the interphalangeal joint refers to: 1) the joint that attaches a first selected phalange to a second selected phalange; or, 2) the joint that attaches a phalange to a metacarpal.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Metacarpal Bone: As used in this disclosure, the metacarpal bone refers to one of several bones of the hand that are enclosed by the palm of the hand. The metacarpal bones attach the bones of the wrist to the phalange bones of the fingers.

Phalange Bone: As used in this disclosure, the phalange bone refers to one of several bones of the hand that are enclosed by the fingers of the hand.

Mirror Image: As used in this disclosure, a mirror image refers to a second object that is a reproduction of a first object wherein the second object is identical to the first object except that the orientation of the second object is reversed relative to the first object as if the second object has been reflected by a plane of a mirror (often called the mirror plane or plane of reflection).

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Palm: As used in this disclosure, the palm of the hand is identified as the portions of a left hand and a right hand between the fingers and the wrist that contact each other when the left hand presses against the right hand when the left hand and right hand are in alignment. The palm encloses the metacarpal bones of the hand. The palm of the left hand is the mirror image of the palm of the right hand. The palm encloses the metacarpal bones of the hand.

Patient: As used in this disclosure, a patient is a person who is designated to receive a medical treatment, therapy, or service. The term patient may be extended to an animal when used within the context of the animal receiving veterinary treatment or services.

Phalange Bone: As used in this disclosure, the phalange bone refers to one of several bones of the hand that are enclosed by the fingers of the hand.

Purlicue: As used in this disclosure, the purlicue refers to the space between the thumb and the index finger of a hand.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared objects are not significantly different.

Standing End: As used in this disclosure, the standing end refers to the end of a rope or line that is not involved with a knot. The standing end is usually the end opposite the working end of a rope or line.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Therapeutic: As used in this disclosure, therapeutic is an adjective that refers to a medical, ameliorative, or hygienic substance, process, procedure, or device.

Tight Fit: As used in this disclosure, a tight fit refers to the insertion of a first object into a second object such that there is not a lot of space between the first object and the second object. By not a lot of space is meant that friction occurs when the first object moves within the second object. Use Friction and Fitted (Below).

Trank: As used in this disclosure, the trank refers to the portion of a glove that covers the hand from the fingers to the wrist.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Working End: As used in this disclosure, the working end refers to the end of a rope or line that forms a knot. The working end is usually the end opposite the standing end of a rope or line.

Wrist: As used in this disclosure, the wrist refers to an eight bone structure within the human body that flexibly attaches the radial bone and the ulna bone to the metacarpal bones of the hand.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic exercise device for hand and arm comprising:

an anchor cord having a first end and an opposite second end;

a glove structure comprising an anchor bar, a plurality of finger stalls and a plurality of elastic cords, wherein the plurality of elastic cords attach the plurality of finger stalls to the anchor bar; and a suspension structure attaching and transferring a load of the glove structure to the anchor cord, the suspension structure comprising a suspension cord and a pair of anchor caps, wherein each anchor cap of the pair of anchor caps is attached to a congruent end of the anchor bar, and each anchor cap is further attached to an end of the suspension cord, wherein the pair of anchor caps transfer the load of the glove structure from the anchor bar to the suspension cord, wherein the anchor cord is attached at the first end to a bight loop formed on the suspension cord, the anchor cord: a) secures the therapeutic exercise device for hand and arm to an externally provided anchor point, and b) suspends the therapeutic exercise device for hand and arm from the externally provided anchor point, and wherein the anchor cord transfers the loads of the suspension structure and the glove structure to the externally provided anchor point.

2. The therapeutic exercise device for hand and arm according to claim 1, wherein the therapeutic exercise device for hand and arm is a strength training device.

3. The therapeutic exercise device for hand and arm according to claim 2, wherein the glove structure is a trunkless glove that is worn on the hand and secures the fingers of the hand to the suspension structure, and wherein the glove structure is an elastic structure that provides resistance to strengthen the hand and the fingers of the hand.

4. The therapeutic exercise device for hand and arm according to claim 3, wherein the anchor cord is roughly inelastic.

5. The therapeutic exercise device for hand and arm according to claim 4, wherein the anchor bar is a rigid prism shaped structure that transfers the loads of the plurality of elastic cords and the plurality of finger stalls to the suspension structure, and suspends the plurality of elastic cords and the plurality of finger stalls above a supporting surface.

6. The therapeutic exercise device for hand and arm according to claim 5, wherein each finger stall of the plurality of finger stalls is an elastic tubular structure configured to receive a finger of the hand, and wherein each finger stall is attached at a congruent end to a first end of an elastic cord of the plurality of elastic cords.

7. The therapeutic exercise device for hand and arm according to claim 6, wherein the plurality of elastic cords of the glove structure provide the resistance used to exercise and strengthen the hand and the fingers of the hand, wherein the plurality of elastic cords are deformed by movement of the hand and the fingers of the hand, and wherein each elastic cord attaches at a second end to the anchor bar and transfers the load of a corresponding finger stall to the anchor bar.

8. The therapeutic exercise device for hand and arm according to claim 7, wherein each anchor cap of the pair of anchor caps is a fastening device, and wherein the suspension cord is a flexible cord, that transfers the load of the glove structure to the anchor cord.

9. The therapeutic exercise device for hand and arm according to claim 8, wherein the anchor cord comprises a working carabiner attached to the first end of the anchor cord, and a standing carabiner attached to the second end of the anchor cord, wherein the working carabiner attaches the first end of the anchor cord to the bight loop of the suspension cord and the standing carabiner attaches the second end of the anchor cord to the externally provided anchor point, and wherein the first end of the anchor cord receives the loads of the suspension structure and the glove structure and the second end of the anchor cord transfers the loads of the suspension structure and the glove structure to the externally provided anchor point.

10. The therapeutic exercise device for hand and arm according to claim 9, wherein the plurality of finger stalls comprises five finger stalls configured to receive the five fingers of the hand.

11. The therapeutic exercise device for hand and arm according to claim 10, wherein the plurality of elastic cords comprises five elastic cords, and wherein the five elastic cords are attached to the five finger stalls.

* * * * *